US008066655B2

(12) United States Patent
Prather

(10) Patent No.: US 8,066,655 B2
(45) Date of Patent: Nov. 29, 2011

(54) PROTECTIVE GLOVE

(76) Inventor: William R. Prather, Edwards, CO (US)

( * ) Notice: Subject to any disclaimer, the term of this patent is extended or adjusted under 35 U.S.C. 154(b) by 1098 days.

(21) Appl. No.: 11/903,991

(22) Filed: Sep. 25, 2007

(65) Prior Publication Data

US 2009/0077706 A1 Mar. 26, 2009

(51) Int. Cl.
*A61F 5/00* (2006.01)

(52) U.S. Cl. ..... 602/20; 602/21; 602/22; 2/16

(58) Field of Classification Search ..... 602/20–23; 128/878–880; 2/16, 20, 160, 161.1, 161.5, 2/161.6, 162, 166, 177; 482/44–46, 49–50
See application file for complete search history.

(56) References Cited

U.S. PATENT DOCUMENTS

| | | | | |
|---|---|---|---|---|
| 3,707,730 | A | 1/1973 | Slider | |
| 4,524,464 | A | 6/1985 | Primiano | |
| 4,632,105 | A | 12/1986 | Barlow | |
| 4,709,694 | A | 12/1987 | O'Connell | |
| 4,953,568 | A | 9/1990 | Theisler | |
| 5,456,650 | A * | 10/1995 | Williams et al. | 482/47 |
| 5,608,912 | A | 3/1997 | Cumberland | |
| 5,787,896 | A | 8/1998 | Sackett | |
| 5,802,614 | A * | 9/1998 | Melone, Jr. | 2/161.1 |
| 5,899,870 | A | 5/1999 | Deirmendjian | |
| 6,010,473 | A * | 1/2000 | Robinson | 602/21 |
| 6,093,165 | A | 7/2000 | Estwanik | |
| 6,520,925 | B1 | 2/2003 | Thibodo | |
| 6,694,523 | B2 * | 2/2004 | Hurst | 2/161.7 |
| 6,783,507 | B1 | 8/2004 | Fisher | |
| 6,944,884 | B1 * | 9/2005 | Sokolowski | 2/161.1 |
| 7,475,433 | B2 * | 1/2009 | Coulter et al. | 2/160 |
| 2004/0210179 | A1 | 10/2004 | Fisher | |

* cited by examiner

*Primary Examiner* — Michael A. Brown
(74) *Attorney, Agent, or Firm* — Douglas E. Warren

(57) ABSTRACT

A protective glove is disclosed that provides a user with protection against radial luxation or subluxation of the user's thumb during activities in which the user's thumb can be subjected to forces that may dislocate the thumb in relation to the hand. In one preferred embodiment, the protective glove is a ski glove that includes a bracing element to prevent injurious movement of a snow skier's thumb when a ski pole used by the skier forcefully reacts to movement of the ski pole as the pole is inserted or dragged within the snow upon which the skier is skiing. In other embodiments, the present invention may also be utilized by as user participating in activities such a skiing, rodeos, football, hockey, polo, baseball, and lacrosse.

27 Claims, 8 Drawing Sheets

PROTECTIVE GLOVE

CROSS REFERENCE TO RELATED APPLICATIONS

Not applicable.

STATEMENT REGARDING FEDERALLY SPONSORED RESEARCH

Not Applicable.

BACKGROUND OF THE INVENTION

This invention relates to an apparatus for protecting the fingers of the hand of a user engaged in activities that could result in the dislocation of at least one of the fingers of the user's hand, and in one embodiment of the invention, the apparatus is a glove used by snow skiers that protects the thumb of the skier's hand from being dislocated as a result of the forces generated by the ski poles or other ski equipment used by the skier while snow skiing.

The disruption of the ulnar collateral ligament of the thumb's metacarpophalangeal joint, sometimes identified as "skier's thumb," is a unique type of sports injury. Such injuries include instances where the thumb is completely dislocated (radial luxation of the thumb), or when the thumb is only partially dislocated (radial subluxation of the thumb). In either case, the dislocation can injure the ulnar tendons that connect the thumb to the main bone structure of the forearm.

This type of injury is most common to snow skiers and usually occurs when a ski pole used by the skier unexpectedly hooks into the snow or on object hidden under the snow while the skier is skiing down a slope. The ski pole reacts to this hooking action by tending to move backward in relation to the skier and the skier's hand and fingers. Because this ski pole reaction is unexpected, the skier may not have time to brace the skier's hand and fingers prior to the ski pole movement. In other situations, bracing of the skier's hand may not be able to sufficiently counteract the force of the ski pole as it is kicked backward. The result of such strong and unexpected motions of the ski pole is usually the radial luxation or radial subluxation of the thumb. This occurs when the majority of the reactive pressure of the ski pole is transmitted through a ski glove worn by the skier to the thumb of the skier's hand that is holding the ski pole.

This acute type of thumb injury can also occur when a skier falls while his or her wrist is strapped to a ski pole. During the fall, the tendency is to try to release the pole and extend the hand to break the fall, thereby leaving the thumb extended with the pole resting in the web space between the thumb and the index finger. This results in hyperextension of the thumb and the thumb is usually deviated to the side at the moment of impact. The result is an injury to the ligament on the inside of the thumb that is responsible for stabilizing the thumb during pinch and grip.

Skier's thumb now accounts for a significant number of skiing injuries. In severe cases where ligaments have been completely torn, this injury must be surgically repaired. The ultimate stability of the thumb's ligament is important because of its contribution to the grasping function of the thumb. People with skier's thumb may be able to return to work and even skiing in a short period with proper rehabilitation. However, in the worst situations, the injury can only be repaired through surgery followed by period of extensive rehabilitation.

The occurrence and the severity of such injuries can be reduced by the skier's use of a ski glove that serves the usual purposes of assisting the skier in holding the ski pole, while simultaneously providing a brace for the thumb to prevent the thumb from fully or partially dislocating.

SUMMARY OF THE INVENTION

In accordance with the present invention, a new type of protective glove is disclosed herein that provides a user with the normal gripping and control surfaces needed to grip and use an object while simultaneously providing a bracing component to reduce the potential for radial luxation or subluxation of the user's thumb if the gripped object is unexpectedly subjected to a force that tends to move the object in the user's hand. The protective glove may also reduce injury to a user that is not gripping an object, but where activities engaged in by the user present the risk of having the user's thumb forced into a position that could also result in the radial luxation or radial subluxation of the user's thumb. Examples of uses and activities which could utilize the present invention include, without limitation, ski gloves, rodeo riders, football, hockey, polo, baseball, and lacrosse.

DESCRIPTION OF THE DRAWINGS

In the accompanying drawings which form part of the specification.

Corresponding reference numerals indicate corresponding steps or parts throughout the several figures of the drawings.

While one embodiment of the present invention is illustrated in the above referenced drawings and in the following description, it is understood that the embodiment shown is merely one example of a single preferred embodiment offered for the purpose of illustration only and that various changes in construction may be resorted to in the course of manufacture in order that the present invention may be utilized to the best advantage according to circumstances which may arise, without in any way departing from the spirit and intention of the present invention, which is to be limited only in accordance with the claims contained herein.

DETAILED DESCRIPTION OF AT LEAST ONE EMBODIMENT OF THE INVENTION

Figure 1:
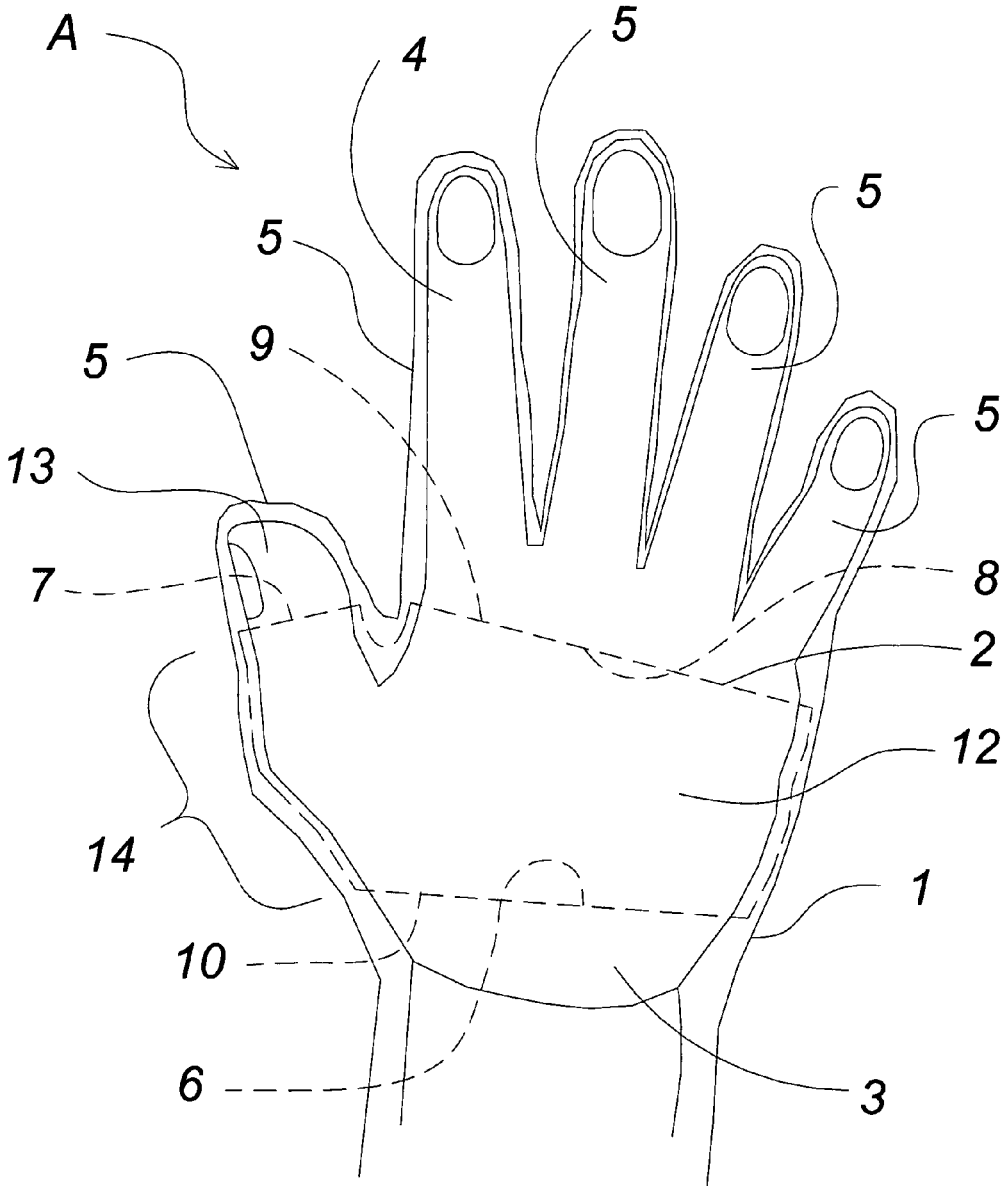
FIG. 1 shows back view of one embodiment of the present invention.
Figure 2:
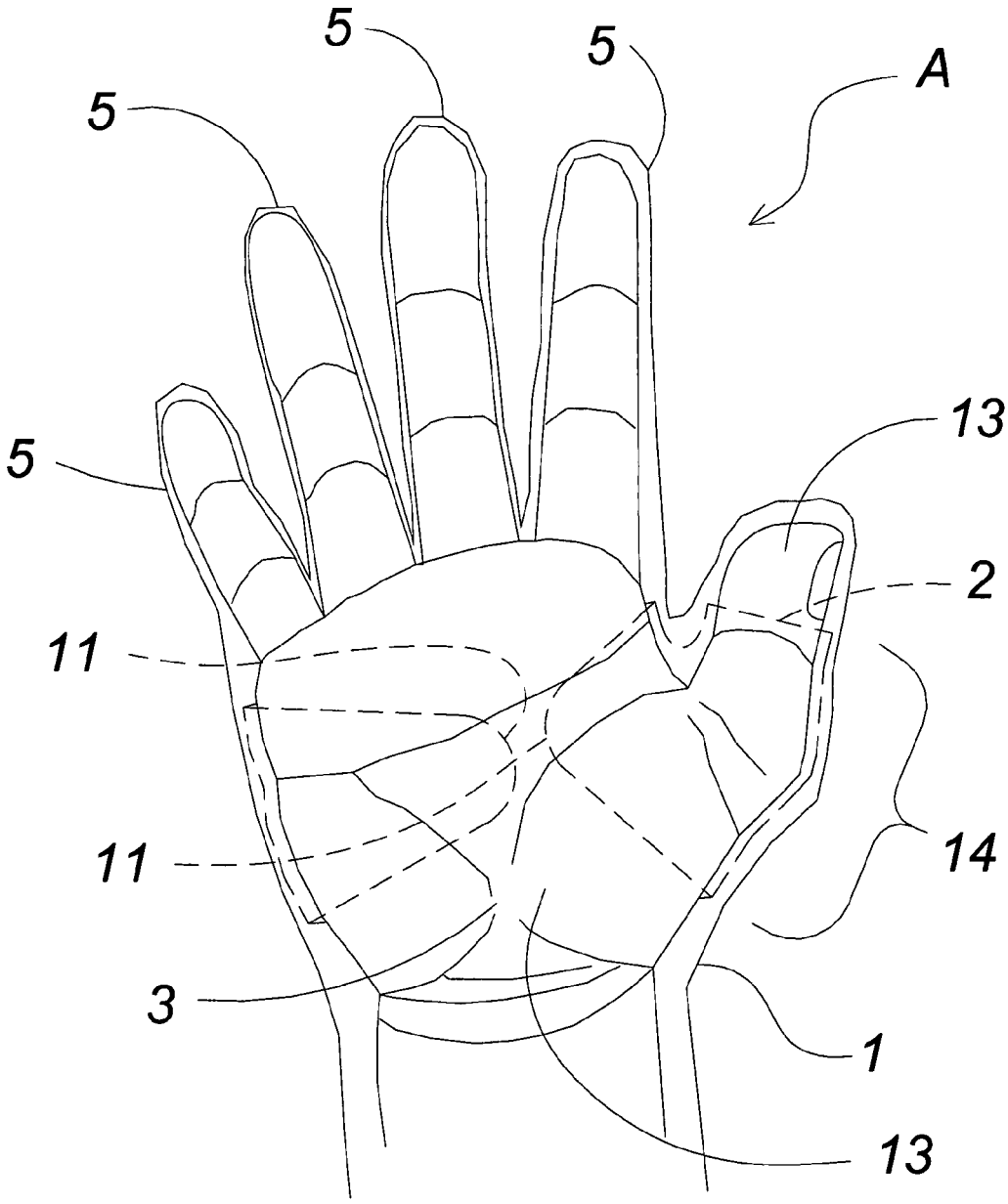
FIG. 2 shows palm view of one embodiment of the present invention.

A preferred embodiment of the protective glove A of the present invention is illustrated in FIG. 1 and FIG. 2. In this embodiment, the protective glove A generally comprises a fingered glove 1 within which a brace element 2 is disposed. A user's hand 3 is inserted into the protective glove A in a manner that allows the user's hand 3 to be inserted into and through the brace element 2 and then allows a set of individual fingers 4 of the user's hand 3 to be further positioned into the fingered portions 5 of the protective glove A.

It will be appreciated that while the embodiment shown in FIG. 1 and FIG. 2 disclose a protective glove A having five individual fingers, other embodiments of the present invention could include less that five fingers and could include any combination of fingers into which any combination of the user's fingers 4 can be inserted. For example, there may be applications wherein the small finger and the adjacent ring finger could be inserted into a single finger element of the protective glove. It is understood that the scope of the present invention includes any possible such combinations of fingers.

The brace element 2 shown in the embodiment of FIG. 1 and FIG. 2 includes a spanning portion 12 the substantially spans across the dorsal side of the user's hand 3 to substantially encircle the metacarpal bones of the four fingers of the user's hand. The spanning portion 12 includes an entry opening 6 at the bottom 10 of the brace element 2, and further comprises a thumb opening 7 and a grouped finger opening 8 at the top 9 of the brace element 2. The entry opening 6 is sized and shaped to allow a user to insert the user's hand 3, the user's thumb and the user's fingers into the entry opening 6 of the protective glove A.

Because the protective glove A can be employed by user's of varying size, it is understood that the protective glove A can be made in a general overall size that best suits the sizes of the varying user's hands. As an example, the protective glove A could be made in varying sizes such as small, medium, large, or extra large.

Figure 5:
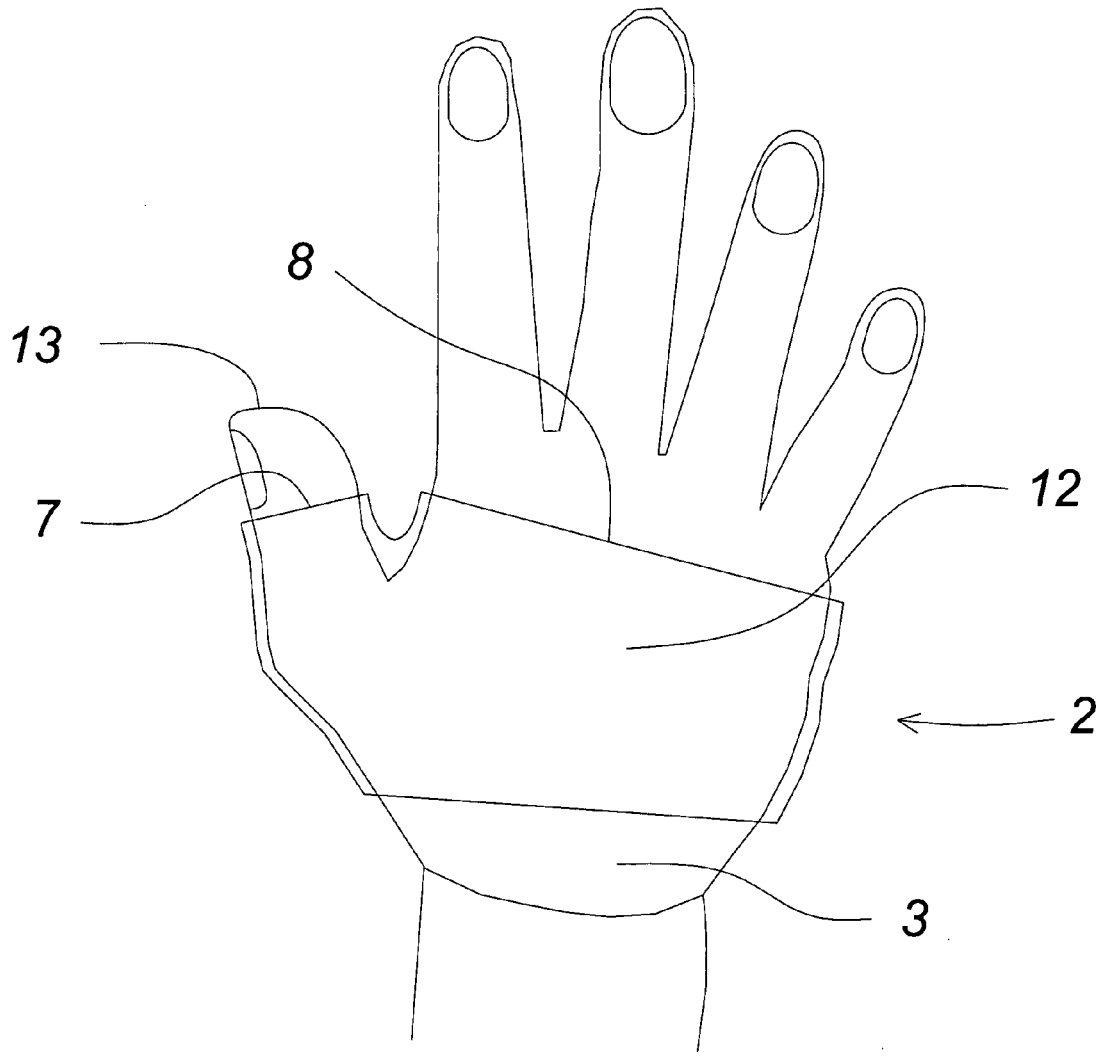
FIG. 5 shows a dorsal view of the brace element in one embodiment of the present invention.
Figure 6:
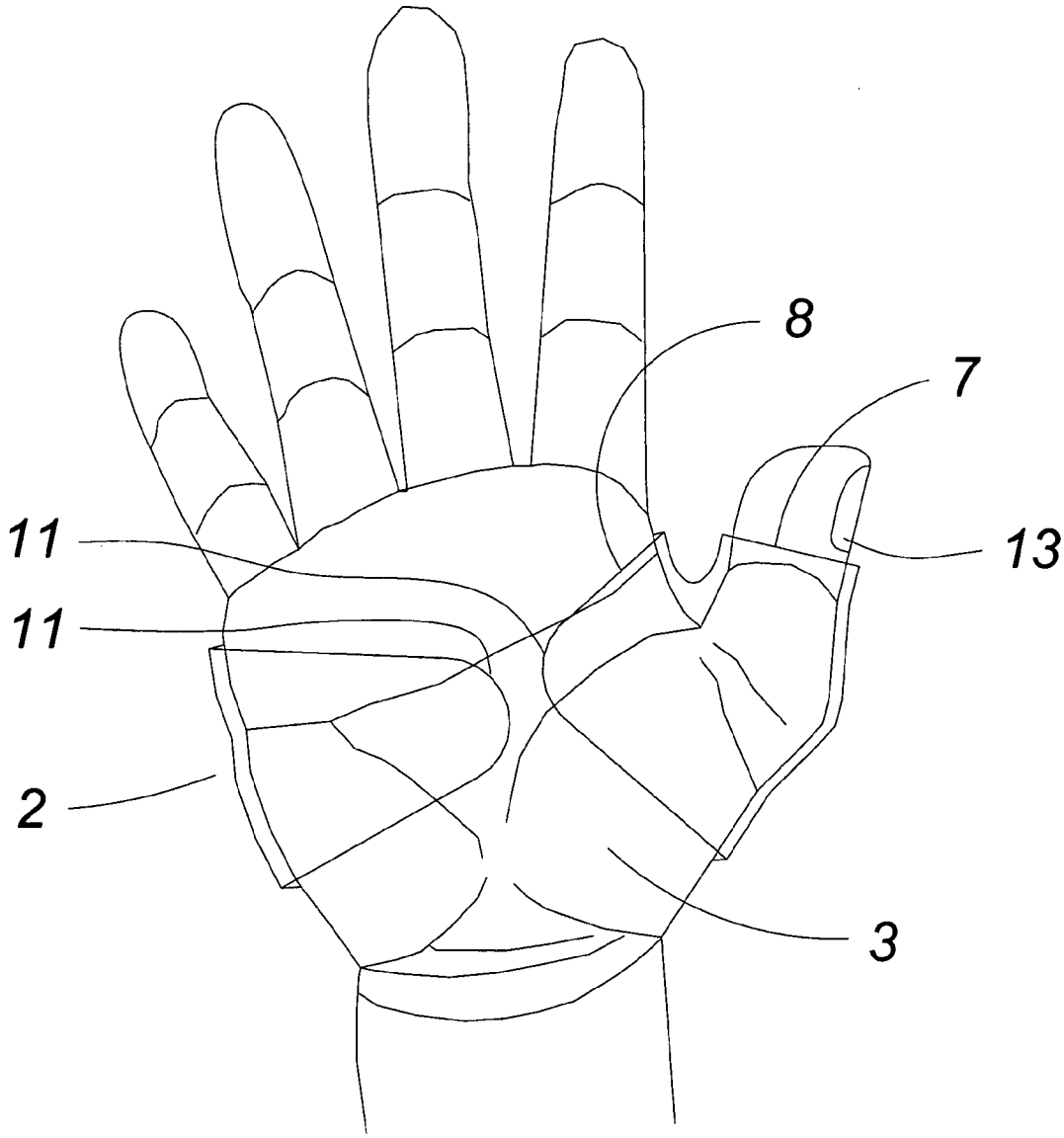
FIG. 6 shows a palm view of the brace element in one embodiment of the present invention.
Figure 7:
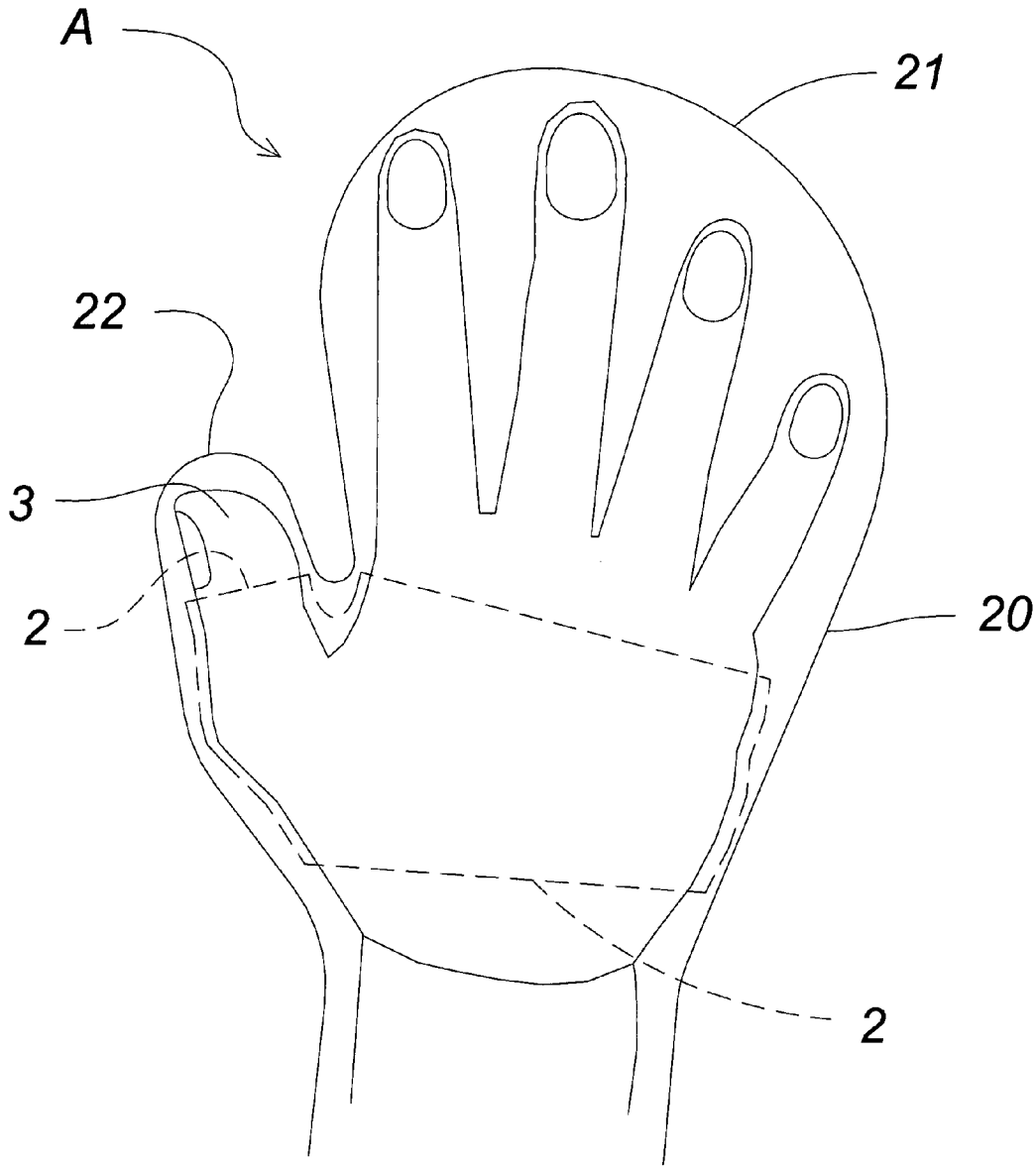
FIG. 7 shows dorsal view of one alternative embodiment of the present invention.

A shown in FIG. 1 and FIG. 5, the brace element 2 is configured to generally span the dorsal side of the user's hand while incorporating the various openings described above. Generally, the brace element 2 substantially encapsulates the proximal phalanx of the thumb and most of the thumbs metacarpal bone. As shown in FIG. 2 and FIG. 6, the brace element 2 on the palm side of the user's hand 3 also includes two protrusions 11. In the present embodiment, the two protrusions 11 do not meet and therefore leave a gap between the closest portions of the two protrusions. In alternative embodiments, the two protrusions 11 can touch or be one continuous element. Between the thumb opening 7 and the grouped finger opening 8, the brace element 2 is formed such that the spanning portion 12 of the brace element is disposed toward the protrusion 11 that is nearest the thumb 13 of the user's hand 3 such that the combination of the spanning portion and the subject protrusion 11 lean toward each other in a manner that tends to encircle the thumb 13 and provide bracing for the proximal phalanx of the thumb.

The general purpose of the two protrusions 11 is to provide bracing elements that coordinate with the spanning portion 12 to provide the required structural integrity needed to allow the brace element 2 to maintain the thumb 13 in a substantially constant location in relation to a palm area 15 of the user's hand 3. It is noted that the user's thumb 13 is generally encapsulated within the thumb bracing portion 14 of the brace element 2. This general encapsulation of the user's thumb 13 acts to reduce the disruption of the ulnar collateral ligament of the user's thumb's metacarpophalangeal joint to thereby substantially reduce the likelihood of radial luxation or radial subluxation of the user's thumb.

It is noted that the thumb bracing element 14 of the present embodiment tends to maintain the user's thumb in a position in which the various bones of the thumb result in a small angle. Although the present embodiment offers the maintenance of the user's thumb in that somewhat angular position, it is understood that in alternative embodiments of the present invention, the bones of the user's thumb can positioned on other ways. For example, the thumb bracing element 14 may also hold the bones of the thumb in a manner that results in the user's thumb being in a generally straight position. Or, in yet other embodiments, the thumb bracing element 14 may hold the bones of the user's thumb in a manner that results in the thumb being in an angular position other than as shown in FIG. 1 and FIG. 2. Alternatively, the thumb bracing element 14 may position the thumb in a manner opposable to the fingers of the user's hand. In any such case, it will be appreciated that the position in which the thumb is held by the thumb bracing element 14 can be of any configuration needed to match a particular application and still remain within the intended scope of the present invention.

Additionally, the thumb bracing element 14 of FIG. 1 and FIG. 2 brace a user's thumb 13 in a location that substantially maintains the user's thumb 13 in an orientation in which the axis resulting from the alignment of the bones in the user's thumb is generally coplanar with the bones of the palm area of the user's hand. However, as noted above in regard to the angular position of the user's thumb, the thumb brace element 14 can be configured to brace the user's thumb in a way in which the axis resulting from the alignment of the bones in the user's thumb can be other than substantially coplanar with the bones of the palm area of the user's hands and still remain within the scope of the present invention.

Figure 3:
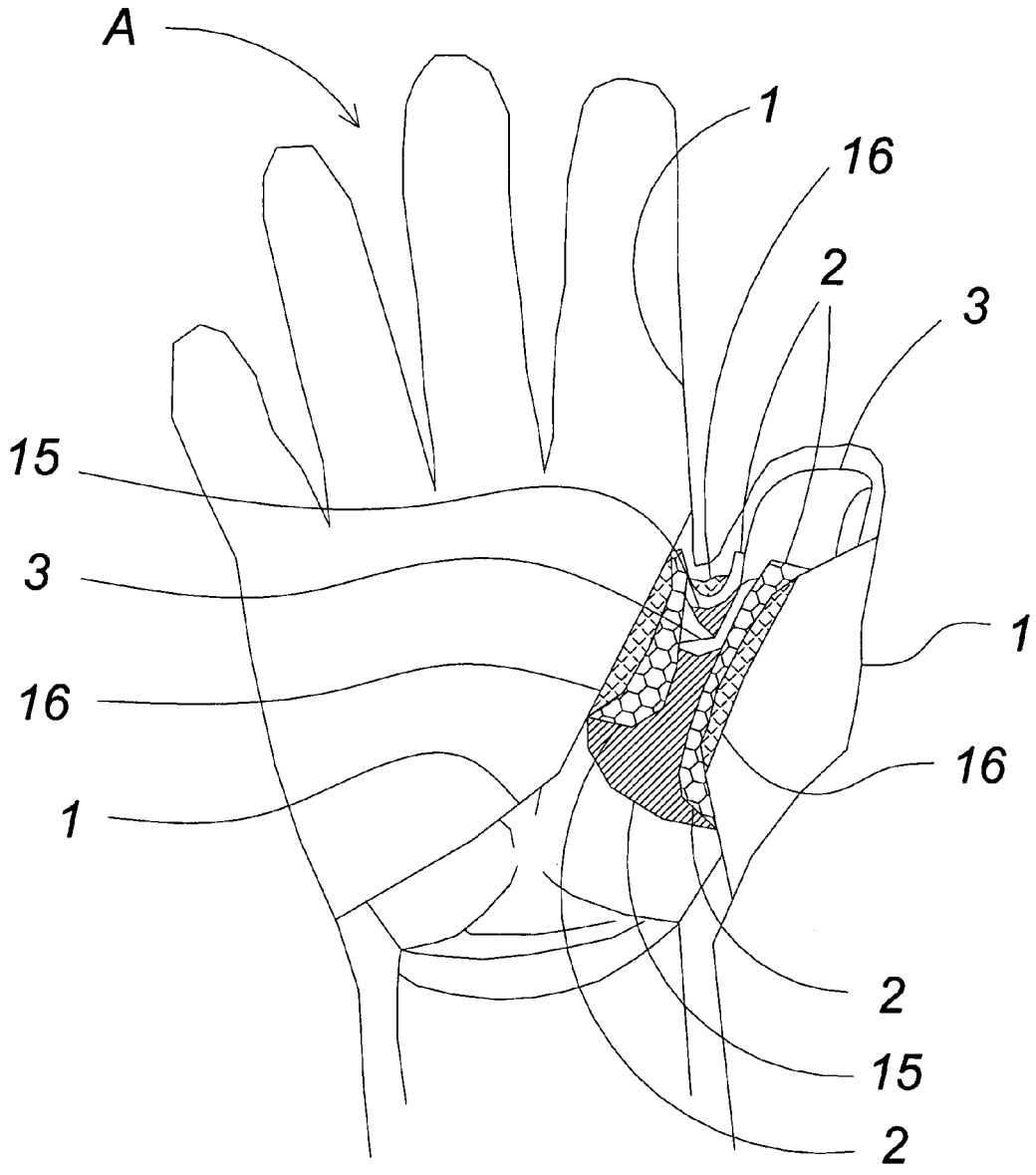
FIG. 3 shows a partial sectional palm view of one embodiment of the present invention.
Figure 4:
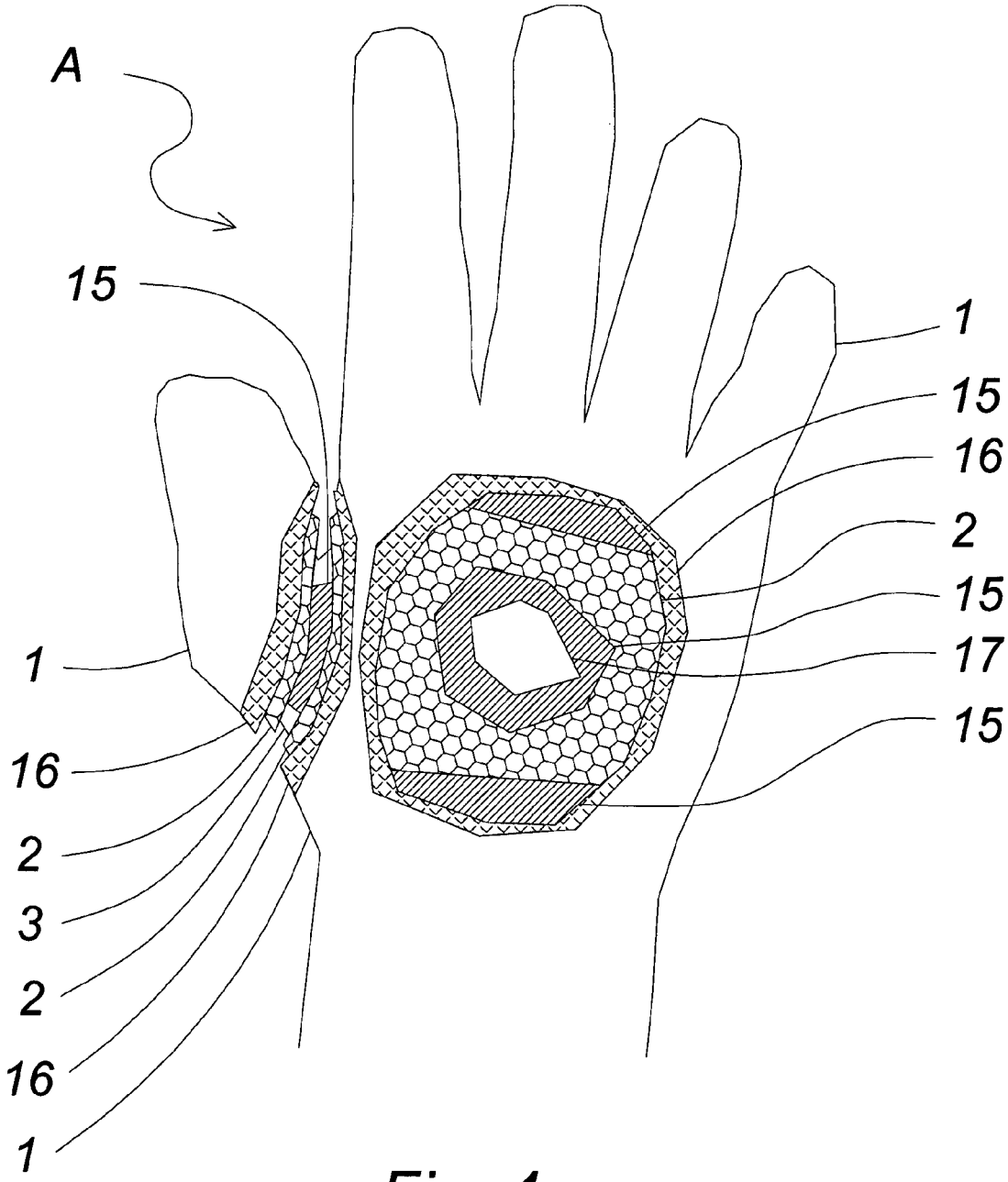
FIG. 4 shows a partial sectional dorsal view of one embodiment of the present invention.

In the present embodiment, it is understood that the brace element 2 is disposed in some manner within the fingered glove 1. In some embodiments, the brace element 2 may be located within the fingered glove 1 such that the brace element is in direct contact with the user's hand 3 while the fingered glove is position away from the hand at the location of the brace element. This is to say that the brace element 2 can be positioned between the user's hand 3 and the fingered glove 1. In other embodiments of the present invention, the brace element 2 can be disposed between various layers of the fingered glove 1. In that embodiment, the brace element 2 would not be in direct contact with the user's hand 3, but may instead be located between two layers of the fingered glove 1. FIG. 3 shows an example of one such embodiment. In FIG. 3, the brace element 2 is substantially disposed in the fingered glove 1 between an inside lining 15 and an outside lining 16. This embodiment is further disclosed in FIG. 4 that shows one version of the shape of the brace element 2 across the back of the user's hand 17.

Additionally, in yet other embodiments, the brace element 2 can be located on the outside of the fingered glove 1. In one version of this embodiment, the brace element 2 can be formed by generally coating a bracing area of a glove with a temporarily liquid material that is in liquid from during the time the bracing area of the glove is immersed in the temporarily liquid material, but which then solidifies later to form the generally rigid brace element 2. In this embodiment, the temporarily liquid material may either coat the inner and outer portions of the glove, or the portions of the glove that contact the temporarily liquid material may become partially or fully impregnated with the temporarily liquid material.

It is understood that the temporarily liquid material can be of any substance that will allow the temporarily liquid material to become rigid enough to generally brace the user's thumb after the temporarily liquid material has solidified. For example, the temporarily liquid material can be a form of plastic or a resin and still remain within the scope of the present invention.

Regardless of the of disposition of the brace element 2 in relation to the user's hand 3 and the fingered glove 1, each of those preparation of embodiments that are within the intended scope of the present invention.

The brace element 2 can be manufactured using a wide variety of acceptable materials. For example, in the present embodiment, the brace element 2 is made from a plastic material formed into the general shape of that portion of a user's hand 3 that will reside within the brace element when the protective glove is in use on the user's hand. In other embodiments other materials may also be used. In fact, any material can used and remain within the scope of the present invention as long as the material selected can be molded or formed as needed to generally encapsulate the user's thumb and can be used to generally support the brace element 2 as it braces the user's thumb 13.

Figure 8:
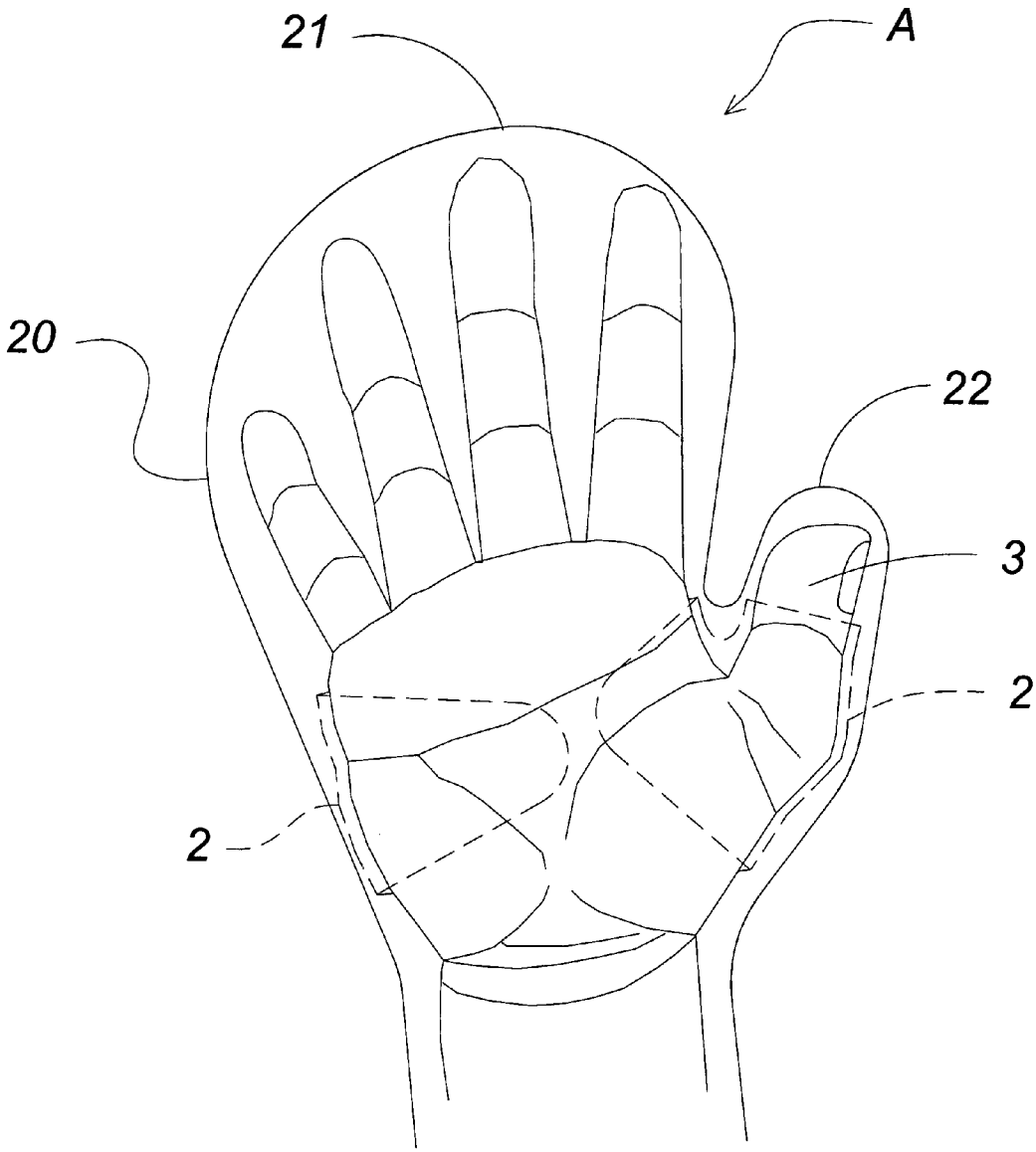
FIG. 8 shows a palm view of one alternative embodiment of the present invention.

In yet another embodiment of the present invention, the glove may not be a fingered glove, but may instead be a mitten type glove. FIG. 8 and FIG. 9 show one example of such an embodiment. There, the mitten glove 20 includes a first enclosure 21 into which the user's first, middle ring, and little finger can be disposed, and a second enclosure 22 into which the user's thumb 3 can be disposed. The brace element 2 resides within the confines of the mitten glove 20 and, as in the aforementioned embodiments, can be disposed adjacent to the user's hand, between the layers of the mitten glove, or generally on the outside surface of the mitten glove. All other characteristics, elements, and alternative embodiments are as defined in the previous embodiments.

While the above description describes various embodiments of the present invention, it will be clear that the present invention may be otherwise easily adapted to fit any configuration where a protective glove device is required. Additionally, as various changes could be made in the above constructions without departing from the scope of the invention, it is also intended that all matter contained in the above description or shown in the accompanying drawings shall be interpreted as illustrative and not in a limiting sense. The scope of the invention should be determined by the appended claims and their legal equivalents, rather than by the examples given.

What is claimed is:

1. A protective glove comprising a glove and a brace element made from a substantially rigid material;

wherein the brace element is an element of the glove;

wherein the brace element inhibits the movement of a thumb of a user's hand in a manner that reduces at least one of either luxation of the thumb or partial luxation of the thumb;

wherein the user's hand can be inserted into the protective glove in a manner that allows the user's fingers and thumb to be inserted into and through the brace element and that allows the user's fingers to be further inserted into a set of fingered portions of the protective glove; and, wherein the brace element further includes a spanning portion that substantially spans across a dorsal side of the user's hand to substantially encircle the metacarpal bones of a set of four fingers of the user's hand.

2. The protective glove of claim 1 wherein the brace element further includes an entry opening at a bottom of the brace element, a thumb opening at the top of the brace element, and a grouped finger opening at the top of the brace element.

3. The protective glove of claim 2 wherein the entry opening is sized and shaped to allow a user to insert the user's hand, the user's thumb, and the user's set of four fingers into the entry opening of the protective glove.

4. The protective glove of claim 3 wherein the brace element generally spans the dorsal side of the user's hand.

5. The protective glove of claim 4 wherein the brace element substantially encapsulates the proximal phalanx of the thumb and the thumb's metacarpal bone.

6. The protective glove of claim 5 wherein the brace element further comprises two protrusions on the palm side of the user's hand such that the two protrusions do not meet and thus leave a gap between the closest portions of the two protrusions.

7. The protective glove of claim 6 wherein the brace element is formed such that the spanning portion of the brace element is disposed toward one of the two protrusions that is nearest the thumb of the user's hand such that the combination of the spanning portion and the subject protrusion lean toward each other in a manner that tends to encircle the thumb and provide bracing for the proximal phalanx of the thumb.

8. The protective glove of claim 7 wherein the brace element has sufficient structural integrity to allow the brace element to maintain the thumb in a substantially constant location in relation to a palm area of the user's hand to reduce the disruption of the ulnar collateral ligament of the user's thumb's metacarpophalangeal joint to thereby substantially reduce the likelihood of radial luxation of the user's thumb or radial subluxation of the thumb.

9. The protective glove of claim 8 wherein the brace element tends to maintain the user's thumb in a position in which the bones of the user's thumb are generally axially aligned.

10. The protective glove of claim 8 wherein the brace element tends to maintain the user's thumb in a position in which the bones of the user's thumb are not generally axially aligned.

11. The protective glove of claim 10 wherein the brace element substantially maintains the user's thumb in an orientation in which the axis resulting from the alignment of the bones in the user's thumb is generally coplanar with the bones of the palm area of the user's hand.

12. The protective glove of claim 10 wherein the brace element substantially maintains the user's thumb in an orientation in which the axis resulting from the alignment of the bones in the user's thumb results in the orientation of the thumb that is generally opposable to the set of fingers of the user's hand.

13. The protective glove of claim 12 wherein the brace element is disposed between the user's hand and the fingered glove.

14. The protective glove of claim 12 wherein the brace element is disposed between at least two of a plurality of layers of the protective glove.

15. The protective glove of claim 12 wherein the brace element is disposed on an outside of the protective glove.

16. The protective glove of claim 12 wherein the glove is not a fingered glove having separate enclosures that individually and substantially encapsulate each of the user's set of fingers.

17. The protective glove of claim 10 wherein the brace element is formed by generally coating a bracing area of the protective glove with a temporarily liquid material that is in liquid form during the time the brace element is immersed in the material, but that then solidifies later to form the brace element.

18. The protective glove of claim 17 wherein the temporarily liquid material at least one of either coats an inner and an outer portion of the protective glove, partially impregnates the brace element with the temporarily liquid material, or substantially impregnates the brace element with the temporarily liquid material.

19. The protective glove of claim 5 wherein the two protrusions touch.

20. The protective glove of claim 5 wherein the two protrusions form substantially one continuous element.

21. A protective glove comprising:

a glove;

a brace element that substantially inhibits the movement of a thumb of a user's hand in a manner that reduces at least one of either luxation of the thumb or partial luxation of the thumb, wherein the brace element is made from a substantially rigid material, wherein the brace element includes a spanning portion that substantially spans across a dorsal side of the user's hand to substantially encircle the metacarpal bones of a set four fingers of the user's hand, and wherein the brace element spans the dorsal side of the user's hand, and wherein the brace element substantially encapsulates the proximal phalanx of the thumb and the thumb's metacarpal bone.

22. The protective glove of claim 21 wherein the brace element has sufficient structural integrity to allow the brace element to maintain the thumb in a substantially constant location in relation to a palm area of the user's hand to reduce the disruption of the ulnar collateral ligament of the user's thumb's metacarpophalangeal joint to thereby substantially reduce the likelihood of one of either radial luxation of the user's thumb or radial subluxation of the thumb.

23. The protective glove of claim 22 wherein the brace element substantially maintains the user's thumb in an orientation in which the axis resulting from the alignment of the bones in the user's thumb results in the orientation of the thumb that is generally opposable to the set of fingers of the user's hand.

24. The protective glove of claim 23 wherein the brace element is disposed between at least two of a plurality of layers of the protective glove.

25. A protective glove comprising a glove and means for inhibiting movement of a thumb of a user's hand in a manner that reduces at least one of either luxation of the thumb or partial luxation of the thumb, wherein the brace element is made from a substantially rigid material, and wherein said means includes a spanning portion that substantially spans across a dorsal side of the user's hand to substantially encircle the metacarpal bones of a set four fingers of the user's hand, spans the dorsal side of the user's hand, and substantially encapsulates the proximal phalanx of the thumb and the thumb's metacarpal bone.

26. The protective glove of claim 25 wherein said means is disposed between at least two of a plurality of layers of the protective glove.

27. A protective glove comprising:

a glove; and a brace element made from a substantially rigid material, wherein the brace element is an element of the glove;

wherein the brace element inhibits the movement of a thumb of a user's hand in a manner that reduces at least one of either luxation of the thumb or partial luxation of the thumb;

wherein a user's hand can be inserted into the protective glove in a manner that allows the user's fingers and thumb to be inserted into and through the brace element and that allows the user's fingers to be further inserted into a set of fingered portions of the protective glove;

wherein the brace element further includes a spanning portion that substantially spans across a dorsal side of the user's hand to substantially encircle the metacarpal bones of a set four fingers of the user's hand;

wherein the brace element further includes an entry opening at a bottom of the brace element, a thumb opening at the top of the brace element, and a grouped finger opening at the top of the brace element, wherein the entry opening is sized and shaped to allow a user to insert the user's hand, the user's thumb, and the user's set of fingers into the entry opening of the protective glove;

wherein the brace element generally spans the dorsal side of the user's hand;

wherein the brace element substantially encapsulates the proximal phalanx of the thumb and the thumb's metacarpal bone;

wherein the brace element further comprises two protrusions on the palm side of the user's hand; and, wherein the brace element is formed such that the spanning portion of the brace element is disposed toward one of the two protrusions that is nearest the thumb of the user's hand such that the combination of the spanning portion and the subject protrusion lean toward each other in a manner that tends to encircle the thumb and provide bracing for the proximal phalanx of the thumb.

* * * * *